United States Patent [19]

Grant

[11] 4,412,390

[45] Nov. 1, 1983

[54] CENTRIFUGAL SPIN AIR DRYER

[76] Inventor: William P. Grant, 620 Cleveland Ave., Elgin, Ill. 60120

[21] Appl. No.: 319,930

[22] Filed: Nov. 10, 1981

Related U.S. Application Data

[63] Continuation-in-part of Ser. No. 190,020, Sep. 23, 1980, abandoned.

[51] Int. Cl.[3] ..... F26B 11/08

[52] U.S. Cl. ..... 34/58; 68/23 R; 188/166

[58] Field of Search ..... 34/8, 58; 68/23; 188/166; 494/12, 84

[56] References Cited

U.S. PATENT DOCUMENTS

| | | | |
|---|---|---|---|
| 2,857,638 | 10/1958 | Ribeiro | 188/166 |
| 3,057,480 | 10/1962 | Poole | 68/23 |
| 3,744,711 | 7/1973 | Smith | 494/84 |
| 3,747,841 | 7/1973 | Ross | 494/84 |
| 3,795,985 | 3/1974 | Hasebe et al. | 34/58 |

*Primary Examiner*—Larry I. Schwartz
*Attorney, Agent, or Firm*—Lester N. Arnold

[57] ABSTRACT

A high speed dehydrator or centrifugal extractor includes an article receiving rotatable drum or basket driven by a high rpm electric motor, and further includes improvements in the housing assembly and interior mounting of the basket and motor, an improved braking mechanism comprised of a disc-type braking plate rotatable with the basket and a disc-type brake pad to be pressed into engagement therewith during braking operations, a pivotal cover for opening to yield access to the rotatable basket, means for biasing the brake pad toward engagement with the braking plate with the pivotal cover being opened, and linkage mechanism connected to the brake pad and engageable by a closing cover to release the braking mechanism.

3 Claims, 15 Drawing Figures

CENTRIFUGAL SPIN AIR DRYER

BACKGROUND OF THE INVENTION

This application is a continuation in part to copending application entitled "Centrifugal Spin Air Dryer", filed Sept. 23, 1980, by the same inventor and identified as U.S. Ser. No. 190,020, now abandoned, wherein this application adds improvements and subject matter not disclosed in the earlier filed and copending application.

This invention relates generally to high spin centrifugal extractors or dehydrators providing air dryers, and more particularly, to an air dryer or dehydrator including improved housing and basket mounting therein and improved disc-type braking mechanism.

Prior art centrifugal extractors fundamentally include a cabinet or housing enclosure, a high speed drive or power source such as an electric motor, a rotatable high rpm article receiving basket or drum connectible to the electric motor by rotatable shaft means and a braking mechanism for rapidly halting or arresting the spin of the loadable basket. In at least one prior art dehydrator, a top cover assembly or lid is pivotally attached to the housing enclosure and is movable between open and closed positions to provide access or prevent access to the spinning basket, respectively, which lid is attached as by linkage mechanisms to extend between the braking mechanism and the pivotal lid. Heretofore, it has been common practice to provide a brake shoe and liner assembly for comprising the braking mechanism, which shoe-liner assemblies are more subject to wear and tear and replacement than a disc-type braking pad-plate assembly would be, and typically require more complex mechanical configurations for the brake levers therefor.

The drive mechanisms or power sources for prior art extractors are commonly mounted in the interior of the housing enclosures and are exposed to a high moisture laden ambient environment tending to enhance or accelerate corrosion. An improvement would be obtained if the drive motor was mounted within the housing enclosure so as to have direct access to outside ambient air, and to be protected from moisture droplets and moisture laden interior air resulting from the extraction of water from water-laden articles occasioned during spin drying cycles. Prior art extractors have not disclosed improved housing enclosures which protect or shroud the motor from moisture or which disclose improved motor mounting provisions to reduce motor vibrations being transmitted to the exterior housing shroud.

In the prior art dehydrator as referenced above which includes a linkage mechanism connected between the pivotal cover and the brake lever, the opening of the lid to provide access to the rotating basket provides mechanical activation of the braking mechanism to halt the spin of the basket and immediately theretofore has through its pivotal movement, deactivated the drive motor. The closure of the lid releases the braking force and activates the drive motor in that order. This convenient feature of linkage mechanism is incorporated into the present invention in a more simple and economic manner.

SUMMARY

It is an object of the present invention to provide a centrifugal spin air dryer having a rotatable drum or basket to be mounted in direct alignment with and to motor shaft means of a high-rpm electric motor.

It is another object to provide for the activation of the electric motor and release of a normally engaged braking mechanism through a mechanical interaction with a pivotal cover during a closing movement thereof.

It is a further object to provide for the deactivation of the electric motor and engagement of the released braking mechanism through a mechanical interaction with the pivotal cover during an opening movement thereof.

It is yet a further object to provide a simple brake linkage mechanism which is aligned to be engaged and moved against biasing means by the closing lid to effect the release of the braking mechanism, and which is biased to return to an original position wherein the braking mechanism is engaged during the opening of the pivotal lid.

It is yet another object of the invention to provide a disc-type braking mechanism including a rotatable disc-plate and engaging brake pad means.

It is still another object to provide that the rotatable disc-plate is to be mounted to the motor shaft means for simultaneous rotation therewith, and is provided with a moisture protection shroud or cover.

It is still a further object to provide shrouding for the electric motor to protect the motor from direct exposure to excess moisture being extracted from moisture-laden articles placed in the spinning basket.

It is still yet another object to provide an improved housing enclosure which includes an access opening therein for channeling outside ambient air directly to the electric motor.

It is an additional object to provide a relatively small diameter perforated drum or basket open at the top thereof, and accessible through a top cover opening in the housing enclosure to receive wet articles such as clothing.

In a preferred embodiment, a centrifugal extractor or spin air dryer is comprised in combination of cabinet means defining an interior cavity and including top cover or lid means pivotally moveable between closed and open positions for providing selective access to the interior cavity, activatable motor means having rotatable shaft means, article receiving basket means connectible to the shaft means and rotatable therewith upon activation of the motor means, disc-type brake plate means to be mounted to the shaft means, and rotatable therewith, disc-type brake pad means moveable to engage the brake plate means to prevent the rotation thereof, spring biasing means biasing the brake pad means to normally engage the brake plate means with the motor means being deactivated, lever arm means pivotally moveable and having the brake pad means pivotally connected thereto, the spring biasing means engaging the lever arm means and biasing the lever arm to a first position for the brake pad means to engage the brake plate means, post means to be connected to the lever arm means and extendible from the cabinet means in contact alignment with the top cover upon the top cover means being closed, the post means being moveable for moving the lever arm means to release the brake pad means from the brake plate means upon activation of the motor means and closure of the top cover means.

In another embodiment of the invention, the lever arm means and post means are replaced with braking linkage means interconnecting between the brake pad means and the top cover means and including a post member extending a free end portion thereof aligned to be engaged by the top cover means upon the closure thereof, rocker arm means and interlink arm means interconnecting the post member to the brake pad means and providing translation of movement therebetween, spring biasing means biasing the brake pad means to normally engage the brake plate means, switching means for selectively activating and deactivating the motor means upon the closing and opening of the top cover means, respectively, the brake pad means first releasing the brake plate means and the switching means thereafter being activated upon the closing of the top cover means and the switching means first being deactivated and the brake pad means thereafter releasing the brake plate means upon the opening of the top cover means.

In the preferred embodiment of the invention, an improved cabinet means includes a top wall having a first opening defined therein for providing access to the interior cavity and rotatable basket means, and further includes a bottom wall having a second opening defined therein for providing access to the motor means, motor shrouding means envelopes the motor means and communicates and interfaces with the second opening for providing ambient air to the motor means through the second opening, mounting plate means is to be positioned within the interior cavity and has the motor means connectible thereto, bracket means are connectible between the mounting plate means and the top wall of the cabinet means, and shock absorbing means are to be positioned between the bracket means and the mounting plate means for isolating the cabinet means from motor vibrations.

These and other objects of the invention will become immediately obvious and readily apparent to those skilled in the pertinent art upon referring to the following detailed description in combination with the accompanying drawing, of which:

THE DRAWING

DETAILED DESCRIPTION

There is shown in FIGS. 1–7, a centrifugal extractor or dehydrator as was disclosed in the copending application U.S. Ser. No. 190,020 filed by the same inventor, and the following detailed description is substantially repetitive thereof.

Figure 1:
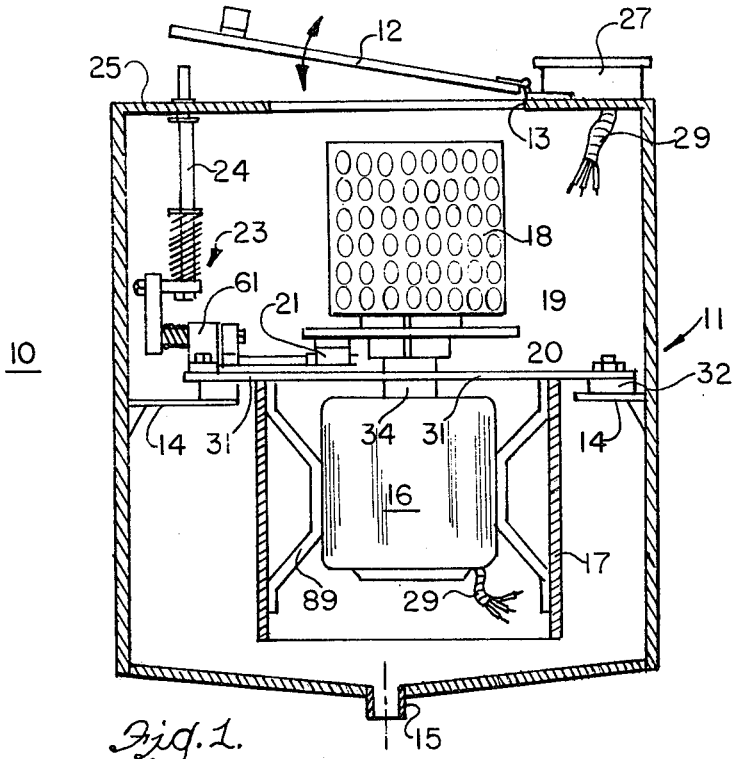
FIG. 1 is a partially sectioned front view of one embodiment of the present invention showing a perforated drum connected to an electric motor and housed within an enclosure having a top-mounted lid.

Referring now to FIG. 1, there is shown a centrifugal dehydrator or spin air dryer 10 including in combination a box-like outer housing enclosure or cabinet 11 defining an interior cavity therein and having a top-mounted cover lid 12, pivotally moveable as indicated by the arrow in FIG. 1, a central top access opening 13, interior mounting framework 14 and a bottom wall drain opening 15, an electric motor 16 protected by an enveloping tubular shroud or cover skirt 17, a perforated cylindrical rotatable drum or basket 18, a disc-type brake plate 19, a disc-type brake pad 21 together comprising braking means or braking mechanism 20, and braking linkage means 23 including a vertically activator post member 24 having the upper or free end extremity thereof positioned to protrude through the top wall 25 of the cabinet 11 in order to be directly engaged and then depressed against spring biasing means by the closing lid 12. A receptacle box 27 is provided within which to mount suitable motor switching means hereinafter described in further detail. The electric motor 16 includes power cable means 29 for interconnecting the electric motor 16 to the switching means within the receptacle box 27, and of course, to a suitable exterior power source (not shown).

Figure 2:
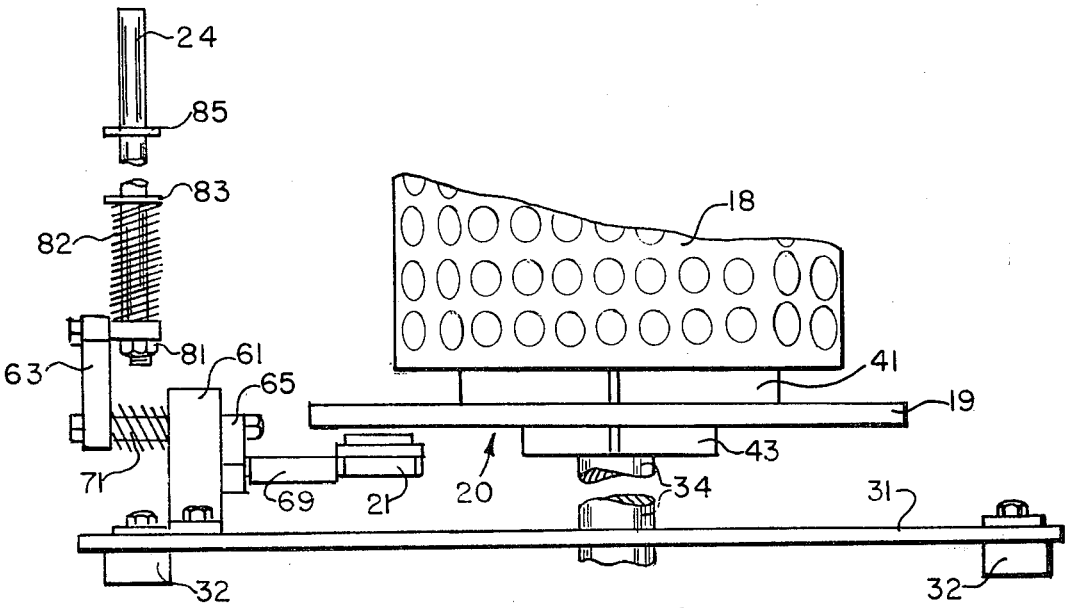
FIG. 2 is an isolated fractional view showing the novel disc-type braking mechanism of the present invention.
Figure 5:
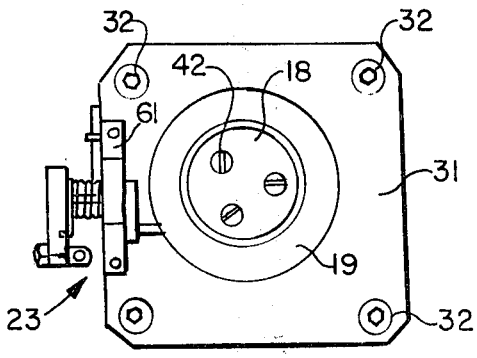
FIG. 5 is an isolated top view of the apparatus of FIG. 2, without the parts thereof being depicted in broken view and without the housing enclosure of FIG. 1.

In FIGS. 1, 2 and 5, there is shown a mounting plate 31 which is mounted to rest upon the interior framework 14 within the cabinet 11. The mounting plate 31 is generally of rectangular configuration and includes shock absorbers or shock arrestors 32 which are suitably mounted in the four corners thereof for direct engagement with the framework 14. The mounting plate 31 includes a centrally disposed opening therein (not clearly shown in the drawing) through which a rotatable shaft 34 may protrude. The centrally disposed shaft 34 is preferably vertically oriented in accordance with the orientations shown in FIG. 1 and may comprise the end or terminal shaft of the electric motor 16 or may alternatively be a separately provided shaft which is suitable aligned with and connectible to the end shaft of the electric motor 16.

In accordance with one novel feature of the present invention, the shaft 34 is the actual end shaft of the electric motor 16, which is shown to be broken in FIG. 2 for convenience of illustration. In accordance with another novel feature of the present invention, the rotating basket 18 is then mounted to the terminating extremity of the shaft 34 through the use of a suitable journal ring 41 to which the basket 18 is secured by suitable fastener means 42 shown in FIG. 5. It is desirable to counter-sink the heads of the fastener means 42 with respect to the bottom wall of the basket 18 in order to eliminate any protrusion of fastener heads into the interior spacing of the basket 18 which might serve as a hazard to spinning garments or hands placed into the rotating basket 18.

The disc-plate 19 of the braking mechanism 20 is also mounted to the shaft 34, and is preferably interleaved between the basket 18 and the electric motor 16. The disc-plate 19 must obviously include a centrally disposed opening through which the shaft 34 may be extended, and includes a journal ring 43 for gripping the shaft 34 as is understood to be a conventional mounting technique. It is readily apparent that upon the electrical activation of the high speed electric motor 16, the rotating speeds (rpm) of the basket 18 and the disc-plate 19 are approximately equal to the rotating speed (rpm) attained by the motor 16.

Figure 6:
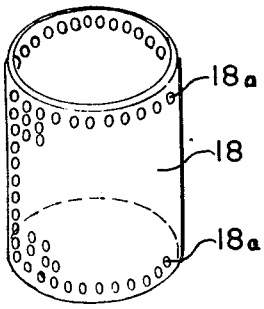
FIG. 6 is an isolated frontal perspective view of a perforated basket or drum means suitable for application with the present invention.
Figure 13:
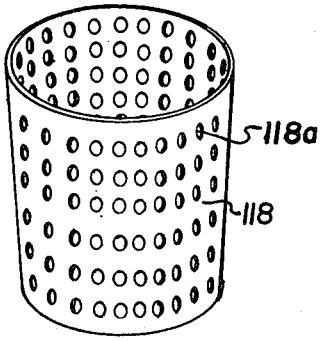
FIG. 13 is an isolated frontal perspective view of an enlarged perforated basket means or drum means.

The basket 18 is provided to be generally cylindrical with upwardly diverging side wall and is elongated in its height dimension on order to comprise a suitable container into which to receive wet garments or clothing articles (not shown). The side wall of the basket 18 includes multiple openings or perforations 18*a* arranged in a columnar pattern of rows, as best shown in FIGS. 6 and 13. The cross-sectional diameter of the basket 18 is obviously a matter of choice largely determined by the article receiving volume desired to be obtained. It is a primary feature of the novel spin dryer 10 to provide the combination of generally small diameter basket 18 into which a single or at most a very select few wet garments are to be placed, and a high rpm electric motor, such as a 3450 rpm rated motor, which will readily supply a high speed centrifugal spin action to the wet garments as needed to spin the garments dry in a matter of seconds. The centrifugally forced water will obviously exit the basket 18 through the perforated openings 18*a*, and be thrown radially outward thereof toward the surrounding side walls of the cabinet 11. The excess and accumulated moisture is provided to exit the cabinet 11 through the bottom wall drain 15. The electric motor 16 is protected from water contact by the use of the cover 17 which is open at the bottom thereof, as is shown in FIG. 1.

Figure 3:
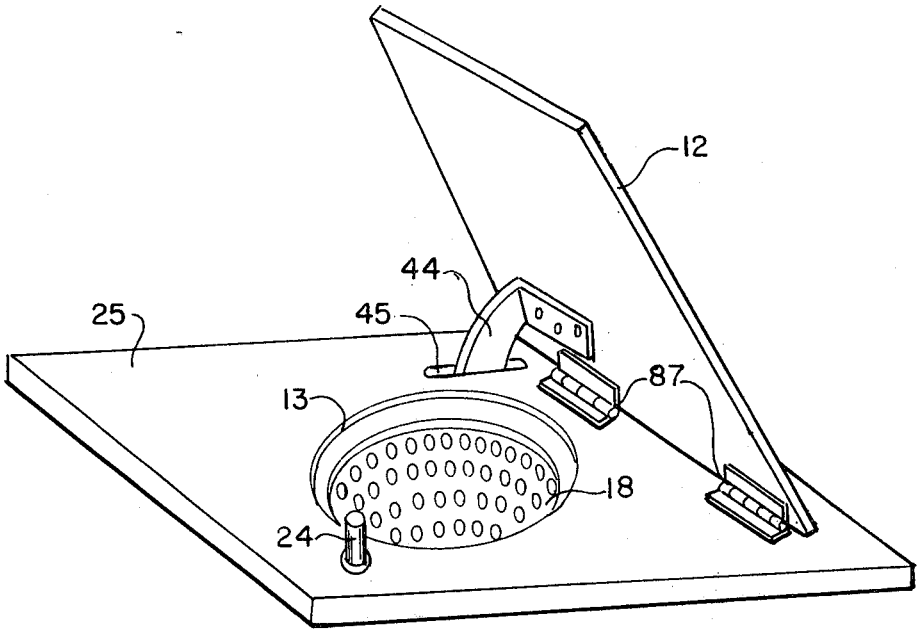
FIG. 3 is an isolated perspective view of a top wall of the housing enclosure depicting a pivotal lid in a partially opened position.
Figure 4:
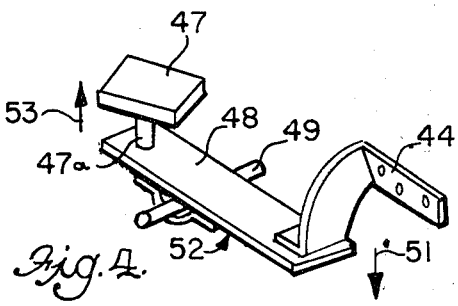
FIG. 4 is an isolated perspective view of switch activation assembly means with switch means as is employed in one embodiment of the present invention.

FIGS. 3 and 4 show an activator bracket arm 44 which is attachable to the pivotal door 12 on the underside thereof and which extends through a suitable slot opening 45 in the top wall 25 and into the interior cavity of the cabinet 11. There is further shown in FIG. 4, an electrical activator switch 47 of the push-button type having a single stem 47*a* to be depressed to activate and to be released to deactivate the switch 47. It is to be understood that the switch 47 is suitably wired with respect to the power cable 29 for the selective provision of electric power to the motor 16. An elongated rocker arm or member 48 is provided and includes a center pivot pin 49. One end of the member 48 is aligned to be contacted by the interiorly positioned end portion of the bracket arm 44, and the other and opposite end thereof is aligned to be pivoted into contact with the switch 47, as is suggested by the direction of the arrows at 51 and 53, respectively. The apparatus disclosed in FIG. 4 comprises motor switching assembly means 52 which can be most conveniently housed within the receptacle box 27 of FIG. 1. Other equally suitable apparatus could as well be devised to comprise the switching means 52, including simply aligning the switch 47 to be directly contacted by the moveable bracket 44 for being depressed to activate the switch 47 and the motor 16, and then being released to deactivate the switch 47 and the motor 16.

It is apparent that the pivotal closing motion of the door 12 will move the bracket 44 inwardly through the slot 45 to depress the button stem 47*a* for the switch 47, and the pivotal opening motion of the door 12 will move the bracket 44 outwardly thereof to release the switch 47. The exact pivotal positions of the door 12 which will actually bring the bracket 44 to have fully depressed the stem 47*a* of the switch 47, and to have released the stem 47*a* enough to deactivate the switch 47 are matters of choice attained through the selection of and positioning of the component parts of the motor switching means 52. However, it is a primary feature of the invention that the electric power shall not be applied to the motor 16 until after the lid 12 is substantially closed in order to prevent access to the basket 18, and until after the braking mechanism 20 is released. Further, upon the opening of the lid 12, the electric motor drive is to be terminated through release of the switch 47 prior to the application of the braking force by the braking mechanism 20; however, the spinning basket 18 must have been brought or braked to a complete stop prior to permitting sufficient hand access to the basket 18 as may be attained through a partially open door 12, or as through any rapid opening of the door 12 and an immediate hand thrust into the basket 18.

In accordance with the present invention, the disc-type braking mechanism 20 is comprised of the disc-plate 19 and the disc-pad 21, and the disc brake pad 21 is applied to or removed from the disc-plate 19 through the action of the braking linkage arm means 23. The linkage arm means 23 includes the vertically positioned post or arm member 24, the upper portion of which is to be extended through the top wall 25 of the cabinet 11 and is to be aligned for direct contact by the door 12 when the door is being closed or is already substantially closed enough to prevent any hand access to the basket 18. The closing movements of the door 12 are coordinated so that firstly, the post 24 is depressed sufficiently to cause the brake pad 21 to be removed from the plate 19, and secondly, the switch 47 is activated through the movement of the bracket 44.

Figure 7:
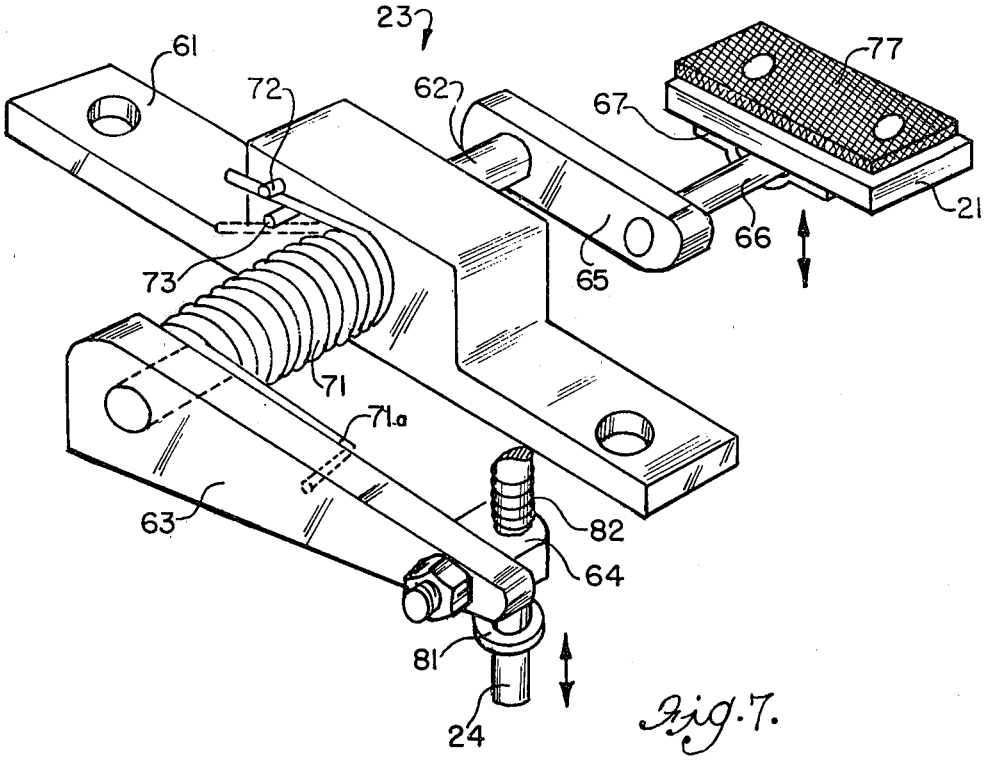
FIG. 7 is an isolated fractional perspective view of a selected portion of the disc-type braking mechanism showing rocker arm means and interlink arm means connectible between a post member and a disc-type brake pad.

FIG. 7 shows a suggested embodiment for the linkage arm mechanism 23 which is comprised in combination of a base mounting bracket 61 securable to the mounting plate 31, a transversely mounted pivot arm or rod 62 to be extended through the central portion of the base bracket 61 and being pivotally mounted with respect thereto. A first rocker arm 63 is connected to one end of the pivot rod 62, a first interlink or linkage arm 64 connected to an opposite and free end portion of the rocker arm 63. The post 24 is connected to the first interlink arm 64 and is extendable therethrough. A second rocker arm 65 is connected to the other and oppositely disposed end portion of the pivot rod 62. A second interlink arm 66 is connected to an opposite and free end portion of the rocker arm 65, and the disc-pad 21 is pivotally connected to the free end portion of the second interlink arm 66 as by the provision of a U-channel bracket 67. There is shown in FIG. 2 a tubular spacer member 69 which may be slipped over the interlink arm 66 to provide the proper spacing and maintenance of the disc-pad 21 from the second rocker arm 65, but which is not deemed essential to the disclosed combination for the linkage arm mechanism 23.

The first rocker arm 63 is biased in a direction upwardly as viewed in FIG. 7, and so as to resist any downward movement or depression thereof as through a depression of the post 24, the bias provided by virtue of the spring coil 71 which comprises a part of the spring biasing means provided for the linkage arm mechanism 23. One end portion 71*a* of the coil 71 is engageable with the rocker arm 63 and the opposite end portion 71*b* is engageable with a selected one of the pair of tines 72 and 73. Adjustment of the tension of the spring coil 71, as suggested by the dashed position of the spring end portion 71*b* of FIG. 6, provides adjustment of the upward bias of the rocker arm 63 and direct corresponding adjustment of the upward bias of the brake pad 21.

The brake linkage arm mechanism 23 is adjustable to provide greater force behind the application of the brake pad to the disc-plate 19, assuring a positive and rapid stop for the rotating basket 18. The bias of the coil 71 is directed to assure the normally-engaged braking application of the brake pad 21 to the disc-plate 19 whenever the post 24 is not depressed by the action of the closure of the lid 12. It is to be noted that a manual depression of the post 24 will result in release of the disc-plate 19, but the switch 47 cannot be activated without actual closure of the lid 12. Hence, the rocker arm means and interlink arm means in combination cooperate to interconnect the post 24 with the disc-pad 21 and to translate direct movement and torquing action therebetween. The relative directions of corresponding movements for each of the post 24 and the disc-pad 21 are indicated by the arrows in FIG. 7.

The disc-pad 21 is further extended by provision at the interlink arm 66 so that the brake pad 21 is positioned well beneath the brake plate 19. The brake pad 21 is intended to engage the underside of the rotatable plate 19. The engagement of the brake pad 21 and brake plate 19 will readily result in frictional braking action in an obvious manner. The pad 21 is preferably provided with a replaceable brake liner strip 77. The braking action of the braking mechanism 20 has been found to be very satisfactory without attempting to provide dual versions of the brake pad 21 or to simultaneously clamp the rotatable disc-plate 19 on both top and bottom surfaces along the outer edge portion thereof.

In accordance with a preferred embodiment of the linkage arm mechanism 23, the post 24 is provided with a slip-through connection with respect to the interlink arm 64 so that the post 24 can be moved with respect to the arm 64, and then there are provided a pair of spaced shoulder collars 81 and 83 (the lower collar 81 could as well be a threadedly engaged nut as shown in FIGS. 1 and 2). A second spring coil 82 is captured between the upper collar 83 and the lower positioned interlink arm 64, so that the post 24 is biased upwardly with respect to the interlink arm 64, but the post 24 can be moved downwardly with respect thereto to compress the spring 82. It is obvious that the spring coil 71 cannot be provided to be so strong as to virtually defeat any downward action of the post 24. A collar 85 is also provided on the upper portion of the post 24 which collar 85 serves as an arresting shoulder to prevent excessive protrusion of the post 24 from the top wall 25 of the spin dryer cabinet 11. The door 12 is conveniently hinged for pivotal motion by brackets 87 connected to the top wall 25 of the cabinet 11. The electric motor 16 is shown to be mounted within the cover 17 by suitable bracing framework 89, but other equally suitable mounting arrangements can be provided including mounting the motor 16 directly to the mounting plate 31. It is to be further noted that there are no heater means provided with the present invention since the spin dryer 10 is of the air dry type desiged to be used at room ambient temperatures.

There is now shown in FIGS. 8–15, another or second preferred embodiment of the centrifugal extractor 10 presenting improved design features over the previously disclosed embodiment as shown in FIGS. 1–7. A wall-mountable cabinet enclosure 101 includes a top wall 102 defining a centrally disposed access opening 103 therein which provides access to the interior cavity space formed by the cabinet enclosure 101, side walls 104 which cooperate to form the box-like enclosure 101, a bottom wall 106 thereof defining a centrally disposed access opening 105 therein, which also provides access to the interior cavity of the cabinet 101, and a wall-mounting bracket assembly 107 attachable to a selected side wall 104 of the cabinet 101 and which bracket assembly 107 is more fully described hereinafter in connection with FIG. 15. The extractor 10 is readily mounted to a wall, or alternatively, other equally suitable mounting provisions could as well be made without departing from the scope and spirit of the present invention.

Figure 10:
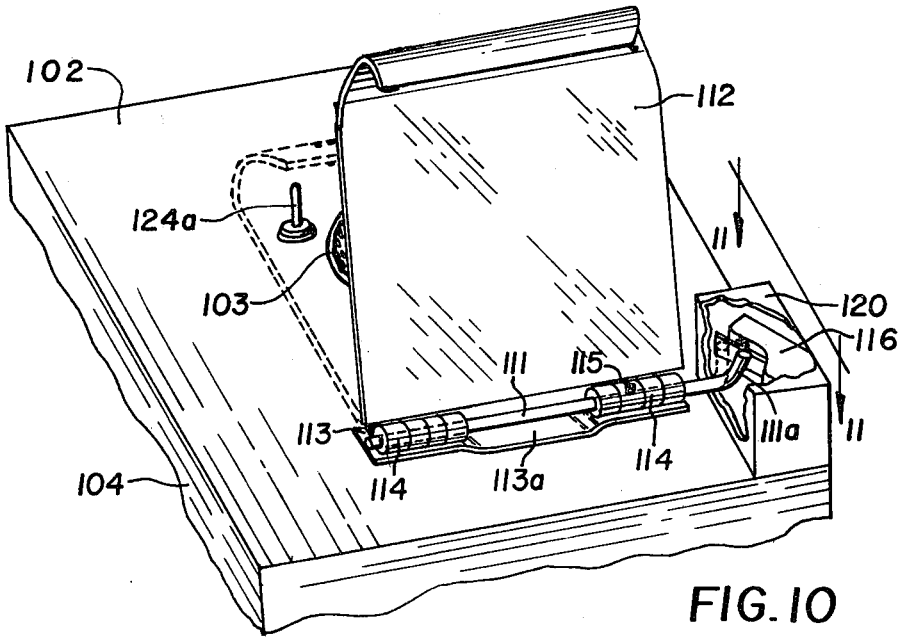
FIG. 10 is an isolated perspective view of the top wall of the cabinet enclosure showing improved pivotal mounting means for the cover means, and showing alternate positions of certain parts in dashed lines.
Figure 12:
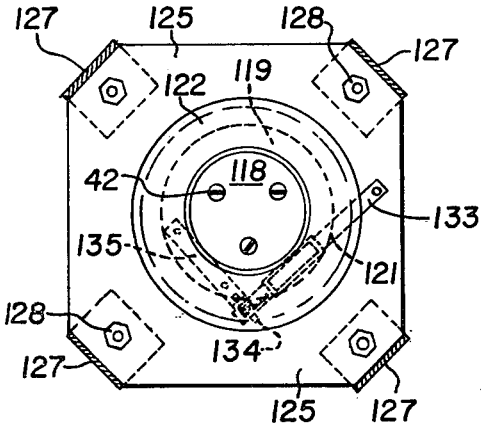
FIG. 12 is an isolated top view of the apparatus within the upper portion of the extractor as shown in FIG. 8, omitting the cabinet housing for clarity.
Figure 11:
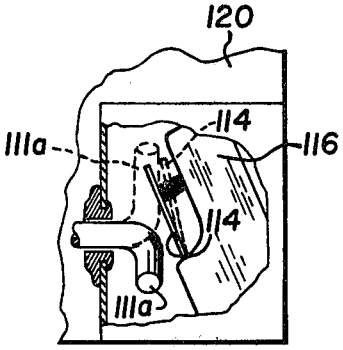
FIG. 11 is a further isolated perspective view, taken along line 11—11 of FIG. 10, improved portion of the pivotal mounting means, and showing an isolated fractional view of switching means having a blade-type activator to be depressed with the movement of the pivotal mounting means.

The cabinet 101 is intended to be improved over the cabinet 11 through the provision of the access opening 105 formed in the bottom wall 106. It is then more convenient to provide for the beveling and inclining of the bottom wall 106 toward a corner located drain opening 108 to which a drain hose, shown at 109 in dashed lines, can be readily attached. A further improvement in apparatus is embodied in the pivotal attachment of a cover lid 112 to the top wall 102, as best shown in FIGS. 10–11. The cover lid 112 is pivotally connected by an elongated pivot pin or rod 111 to a mounting spacer plate 113 by means of a pair of hinges 114 (FIG. 10). The mounting plate 113 is preferably offset along the central portion thereof as shown at 113*a*, that is, with the central plate portion 113*a* connected to the top wall 102, the opposite end portions of the mounting plate 113 are elevated or spaced from the surface of the top wall 102. A threadable fastener 115 is provided to extend through a selected one of the pair of hinges 114 for engaging the hinge 114 and preventing slippage between the hinge 114 and the pivot rod 111.

There is further provided an electrical receptacle housing 120 mounted on the top wall 102 generally adjacent to the hinged location of the lid 112. The pivot rod 111 is turned on its extreme end portion 111*a*, to form a tine, and is extended to interface with the electrical receptacle housing 120, with the tine 111*a* positioned interiorly thereof. The end tine 111*a* of the pivot rod 111 will engage the bottom wall of the receptacle 120 during a rearward pivotal movement (opening) of the lid 112, to provide means for limiting the extent of such opening movement. A suitable push-to-activate microswitch 116, having an outwardly biased activator blade 117, is mounted within the receptacle housing 120 in such a manner that the blade 114 is engaged by the tine 111*a* and depressed to activate the switch 116, when the lid 112 is pivoted forwardly toward its closed position over the access opening 103. The dashed lines for the parts 111*a* and 114 in FIG. 11 clearly show the engagement and depression of the blade 114. This embodiment is intended to be an improvement over the apparatus shown in FIG. 4 of this disclosure.

The electric motor 16 is mounted to suspend from a rigid mounting plate 125 having a central opening therein, not clearly shown in the drawning, through which the terminal motor shaft 34 can be inserted. It is intended to be another improved feature of the extractor 10 to employ extension hanger brackets 127, a bracket 127 to be located in each of four corner positions of the mounting plate 125, to suspend the mounting plate 125 from the top wall 102, whereby electric motor vibrations are not readily transmitted to the side walls 104 of the cabinet housing 101. Shock absorber means 126, held by bolts 128, are insertable between the mounting plate 125 and the attaching brackets 127 for further isolating motor vibrations from being transmitted to the cabinet 101. The mounting of the motor 16 as described herein provides for the weight of the motor 16 to comprise a counterbalancing weight tending to stabilize any unstabling effect of an overbalanced or non-balanced spinning wet load as may be contained in the basket 118. The electric motor 16 is enveloped by a shroud or cover means 117 similar to the cover means 17, which cover 117 protects the electric motor from water being dispensed radially from a spinning basket 118 similar to the basket means 18 earlier described herein.

Figure 8:
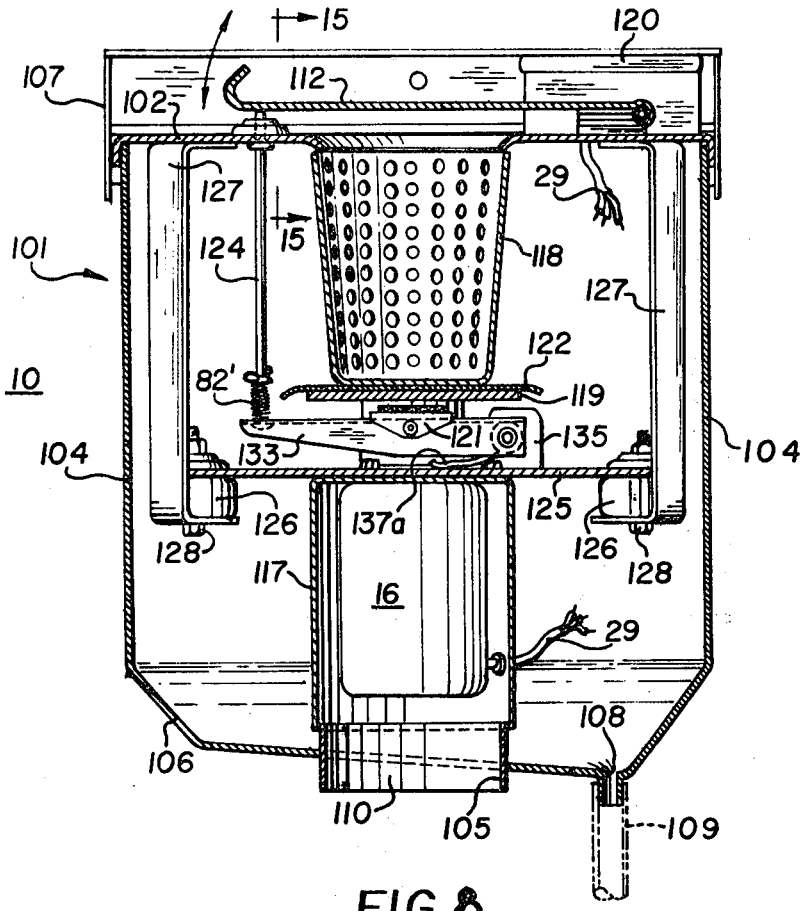
FIG. 8 is a partially sectioned front view of another preferred embodiment of the invention including the cabinet enclosure means, motor means, basket means, motor shrouding means, bracket means and shock absorbing means.
Figure 9:
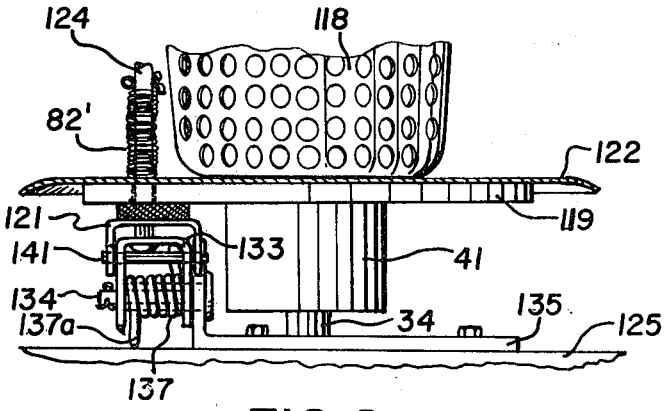
FIG. 9 is an isolated fractional view depicting from another angle than shown in FIG. 8, the novel disc-type braking mechanism of the present invention.

The bottom wall 106 of the cabinet 101 is provided with collar means 110, FIG. 8, interfacing and cooperating with the bottom access opening 105 for extending the opening upwardly into the interior cavity of the cabinet 101. The collar means 110 is telescopingly received within or inserted into the end opening defined by the shroud means 117 to further isolate the electric motor 16 from the waterladen air within the cabinet 101, and to channel fresh outside ambient air to the electric motor 16 to aid in eliminating premature corrosion of the motor 16. The motor 16 is connected to the receptacle box 120 through the cable 29. The basket means 118 is preferably enlarged outwardly from bottom to top but need not be, and the side wall thereof, FIG. 13, is perforated at l18*a* in columnar fashion to enhance water discharge in a conventional manner. The basket means 118 is mounted to the rotatable shaft 34 by the journal ring 41, FIG. 9, and is rotatable therewith on a 1—1 ratio with the activation of the motor 16.

In accordance with this preferred embodiment of the invention, there is provided a flatlike disc-type brake plate 119 similar to the brake plate 19 earlier disclosed, and preferably being mounted to the journal ring 41, and for use in combination therewith, a disc-type frictional brake pad means 121. The brake plate 119 is protected from direct moisture contact by providing an enlarged disc-type cap or cover means 122, the outer circumferential edge portion of which extends outwardly of and downwardly from the brake plate 119. It is obvious that the parts 119 and 122 can alternatively be provided as a single part. The brake pad 121 is comprised of a U-channel bracket 121*a* and brake liner means 121*b* which is intended for frictional contact with the rotatable brake 119 in a conventional manner. The brake pad 121 is pivotally mounted to, as shown by pivot pin 131, an elongated rocker arm 133, itself pivotally mounted at one end thereof by a pivot pin 134 to a mounting angle bracket 135 securable to the mounting plate 125.

Figure 14:
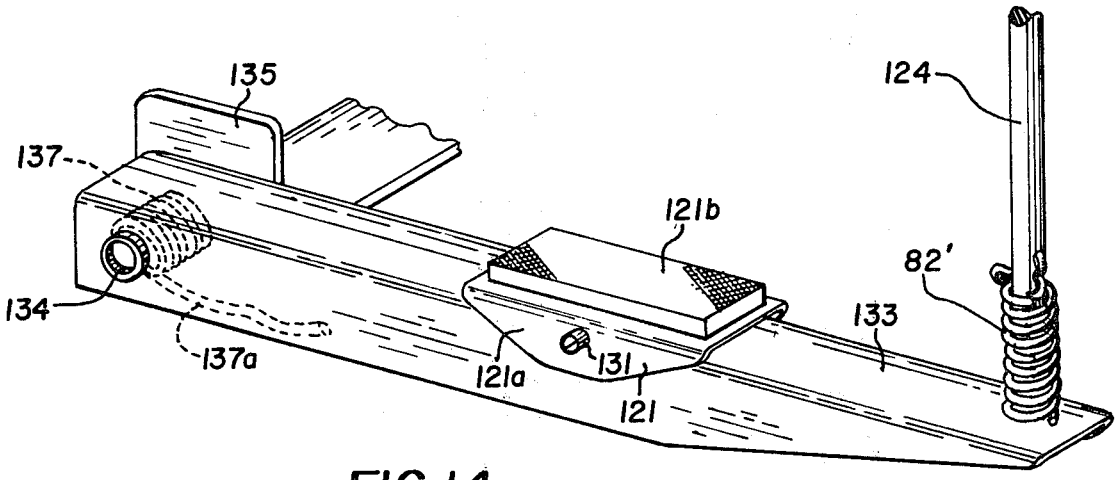
FIG. 14 is an isolated fractional perspective view of an alternative preferred embodiment of a disc-type braking mechanism, showing pivotal rocker arm means connectible to a post member and to a pivotally mounted disc-type brake pad.

As is shown most clearly in FIG. 14, the rocker arm 133 is generally U-shaped and is biased upwardly toward the brake plate 119 by spring means 137 in the form of a spring coil having an extended tine 137*a* which provides a base for the coil 137 against the mounting plate 125. The free end portion of the rocker arm 133 is connected to post means 124 which is very similar to the post 24 as disclosed in FIGS. 1-2, and extends from the rocker arm 133 upwardly to protrude from the top wall 102. The protruding end portion thereof, 124*a* of FIG. 10, is aligned to be in contact with the lid 112 upon the substantial completion of the closing movement of the lid 112.

When the lid 112 is open to an extent that there is no contact between the lid 112 and the post 124, the rocker arm 133 is biased upwardly toward, and the brake pad 121 is in direct contact with, the brake plate 119. Hence, the basket 118 is normally in a braked condition with the braking engagement effective unless the lid 112 is closed to the extent necessary to depress the post 124 and rocker arm 133 against the spring coil 137 so that the braking contact between the brake plate 119 and the brake pad 121 is broken. In the braked condition with the lid 112 in an opened position, the tine 111*a* has released or moved away from activating depression of the microswitch blade 114, and the electric motor 16 is deactivated. Upon the vertical depression of the post 124 causing the downward pivot of the rocker arm 133, the braked condition is released; thereafter, the continuous pivotal movement of the tine 111*a* causes the depression of the blade 114, activation of the switch 116, and operation of the motor 16. The tine 111*a* moving simultaneously with the pivotal movement of the lid 112 comprises motor activating means. The motor is then effective to spin the basket 118 rapidly about its vertical axis to centrifugally force water from water-laden articles placed therein in accordance with the principles of the centrifugal extractor 10. Spring coil means 82 are provided at the base of the post 124 which acts and functions in the same manner as the coil 82 of the earlier described embodiment, see FIG. 2.

Figure 15:
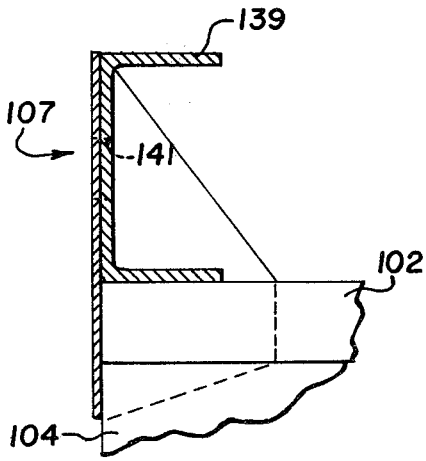
FIG. 15 is a fractional side view of a portion of the cabinet housing taken generally along the lines 15—15 as shown in FIG. 8.

In summary, the cabinet 101 has been improved over the design of the cabinet 11 by providing the bottom access opening 105, which is combination with the shrouding means 117 and 110 cooperate to isolate the electric motor 16 from the expelled water within the cabinet 101. The vibrations naturally resulting from the high rpm spinning of the basket 118, are not as noticeably transmitted to the cabinet 101 when the extension hanger brackets 127 are employed to suspend the electric motor 16 from the top wall 102 of the cabinet 101. The braking mechanism of the embodiment shown in FIG. 8 is greatly simplified in that there is only a single rocker arm 133 which carries the brake pad 101 into engagement with the spinning brake plate 119, and the brake pad 121 is pivotally mounted thereon for movement with respect thereto when frictional contact is made between the pad 121 and the plate 119. Further improvement is found in the provision of tine 111*a* as a part of the pivot pin 111 to activate the switch 116 for enabling the motor 16. Another improvement is to mount the cabinet 101 on a wall by means of bracket 107 as strengthened by U-channel member 139. As shown in FIG. 15, the members 107 and 139 are provided with an opening 141 through which a suitable fastener can be extended.

The materials and sizes and dimensions of parts are immaterial to the essence and scope of the invention disclosed herein, and various choices may be made in order to implement the present invention, although selections of materials should bear in mind the constant exposure to and contact with water as spun from wet garments. The use of fastener means to provide for interconnections of parts can be altered from that shown in the drawing. Various other equivalent and equally useful configurations could no doubt be readily substituted by the skilled practitioner after becoming knowledgeable of the principles and rudiments of the present invention as disclosed herein. The applicant does not intend to be limited to irrelevant and/or non-critical elements which comprise the illustrations of the preferred embodiment of the invention, and it is the intention to cover all equivalent and alternative embodiments through the following claims, to wit:

What is claimed is:

1. A centrifugal extractor apparatus comprising in combination cabinet means defining an interior cavity and including a top wall defining a first opening therein, hinged cover means to be pivotally connected to the top wall and moveable between closed and open positions with respect to the first opening, rotatable shaft means to be mounted in the interior cavity, motor means to be connected to the rotatable shaft for rotating same, basket means for receiving wet articles to be spun dry and being connectible to the rotatable shaft means, braking means to be mounted in the interior cavity and being selectively engageable to arrest the rotational movement of the shaft, brake linkage mechanism connectible to the braking means and being engageable by a substantially closed cover means, motor activation means to be activated during movement of the cover means to the closed position thereof, the improvement comprising rotatable disc-type brake plate means for the braking means to be mounted to the shaft means for rotation therewith, pivotal disc-type brake pad means for the braking means biased to normally engage the brake plate means for preventing rotation, and being selectively moveable to release engagement therewith, pivotal lever arm means for the brake linkage mechanism carrying thereon the pivotal brake padmeans and biased toward engagement with the brake plate means, and post means for the brake linkage mechanism to be connected to the lever arm means and extendible from the cabinet means in alignment for contact by the cover means during closing thereof, the post means being moveable by the closing cover means to move the lever arm means against the bias thereof for selectively releasing engagement between the brake plate means and the brake pad means, and said cabinet means including a bottom wall defining a first opening and a second opening therein, said bottom wall tapering outwardly to converge on the first opening for draining moisture therefrom, enveloping shroud means being mounted within said interior cavity of the cabinet means to envelope the motor means and extending to communicate with the second opening of the bottom wall whereby outside ambient air is excessible to the motor means and the shroud means prevents moisture contact with the motor means.

2. A centrifugal extractor apparatus comprising in combination cabinet enclosure means defining an interior cavity and a first opening in a first wall thereof through which the interior cavity is accessible, hinged cover means to be pivotally connected to the first wall of the cabinet means and being moveable between closed and open positions with respect to the first opening, motor means to be mounted within the interior cavity and having rotatable shaft means, basket means for receiving wet articles to be spun dry and being connectible to the rotatable shaft means, rotatable disc-type brake plate means to be mounted to the shaft means for rotation therewith, pivotal lever arm means biased toward engagement with the brake plate means, pivotal disc-type brake pad means to be pivotally mounted to the lever arm means and biased therewith to normally engage the brake plate means for preventing rotation thereof, and being selectively moveable with movement of the lever arm means to release engagement with the brake plate means, and post means to be connected on one end thereof to the free end portion of the lever arm means and extendible from the interior cavity of the cabinet means in alignment for contact by the cover means during closure thereof, the post means being moveable upon contact and moving the lever arm means against the bias thereof for selectively releasing engagement between the brake plate means and the brake pad means, a second wall defined by the cabinet enclosure means and being disposed oppositely of the first wall, said second wall including first and second openings therein and generally sloping toward one edge portion thereof to converge upon the first opening thereof for comprising a drain opening, shroud means enveloping the motor means and extending to communicate with the second opening of said second wall for enabling the motor means to access ambient air and protecting the motor means from exposure to moisture.

3. The centrifugal extractor as claimed in claim 2 wherein the rotatable disc-type brake plate means includes a downwardly sloped outer circumferential edge portion comprising drip-edge means, and said brake pad means is positioned directly beneath the brake plate means, inwardly of the drip-edge means, for protecting the brake pad means from exposure to moisture independently of whether the spin basket is spinning or standing at rest.

* * * * *